US007461488B2

(12) United States Patent
Black

(10) Patent No.: US 7,461,488 B2
(45) Date of Patent: Dec. 9, 2008

(54) INTERNALLY BRACED STRAW BALE WALL AND METHOD OF MAKING SAME

(75) Inventor: Roy Gary Black, El Cerrito, CA (US)

(73) Assignee: Integrated Structures, Inc., Berkeley, CA (US)

( * ) Notice: Subject to any disclaimer, the term of this patent is extended or adjusted under 35 U.S.C. 154(b) by 764 days.

(21) Appl. No.: 10/775,715

(22) Filed: Feb. 10, 2004

(65) Prior Publication Data

US 2004/0216404 A1 Nov. 4, 2004

Related U.S. Application Data

(60) Provisional application No. 60/446,731, filed on Feb. 10, 2003.

(51) Int. Cl.
*E04B 1/00* (2006.01)
*E04B 1/70* (2006.01)
*E02D 27/00* (2006.01)

(52) U.S. Cl. ..... 52/295; 52/745.09; 52/270; 52/250; 52/302.1

(58) Field of Classification Search ..... 52/295, 52/729.1, 745.09, 561, 250, 270, 302.1
See application file for complete search history.

(56) References Cited

U.S. PATENT DOCUMENTS

| | | | | |
|---|---|---|---|---|
| 5,749,199 | A * | 5/1998 | Allen | 52/729.1 |
| 6,041,566 | A * | 3/2000 | Allen | 52/729.1 |
| 6,061,986 | A * | 5/2000 | Canada | 52/561 |
| 7,073,306 | B1 * | 7/2006 | Hagaman | 52/745.09 |

OTHER PUBLICATIONS

R. Gary Black, Spar and Membrane Structure, The Last Straw, Winter 1997, pp. 10-11, No. 17, published out of Tucson, AZ.

* cited by examiner

*Primary Examiner*—Richard E Chilcot, Jr.
*Assistant Examiner*—Mark R Wendell
(74) *Attorney, Agent, or Firm*—H. Michael Brucker

(57) ABSTRACT

Systems and methods of internally bracing straw bales during construction of a straw bale wall using ladder structures that eliminate the need for external bracing and form a permanent part of the wall's internal structure.

10 Claims, 12 Drawing Sheets

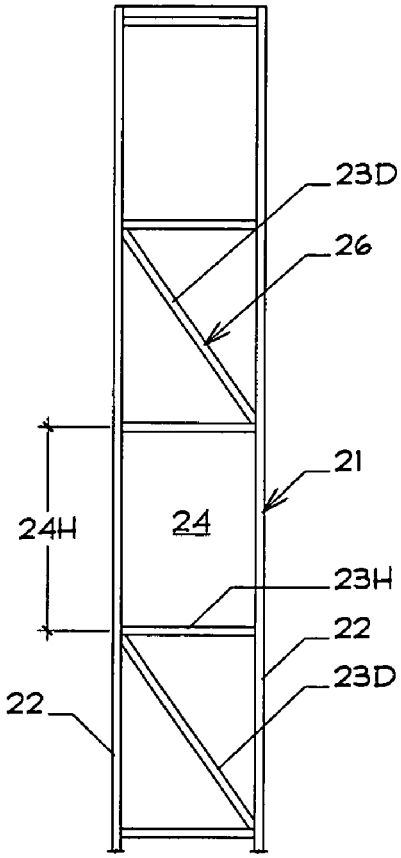
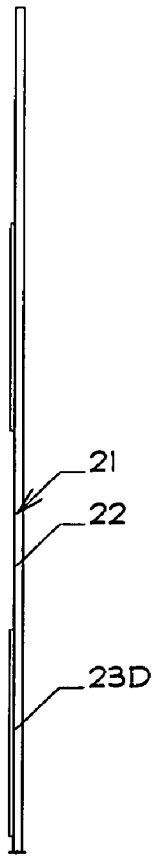
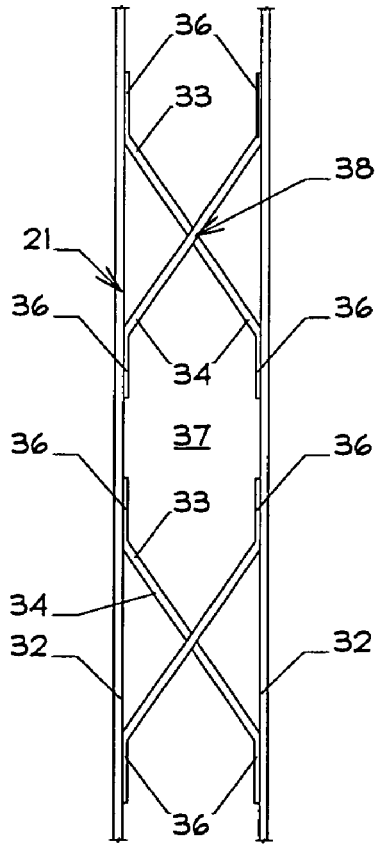
FIG. 8
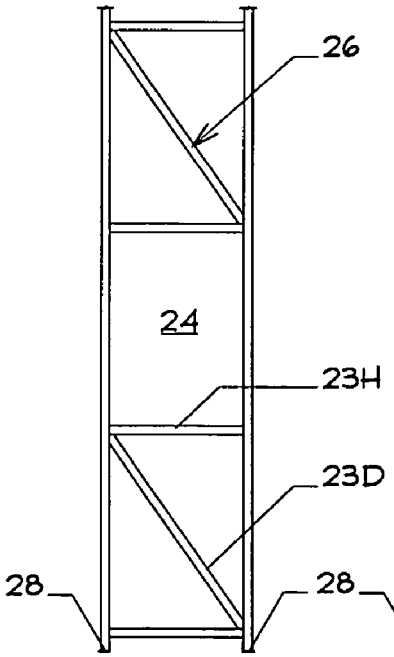
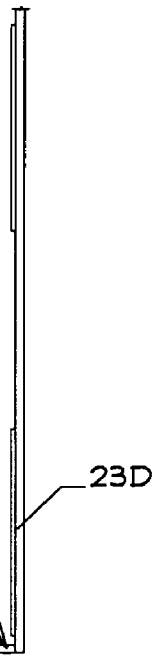
FIG. 6 FIG. 7

INTERNALLY BRACED STRAW BALE WALL AND METHOD OF MAKING SAME

This application claims the benefit of U.S. Provisional Application No.: 60/446,731 filing date Feb. 10, 2003.

BACKGROUND OF THE INVENTION

The present invention relates systems and methods for constructing straw bale core building walls and, more particularly, to such walls with internal structural components that can brace the wall during construction.

The use of straw bales as a core material for building walls is well known in the art, as are the advantages of such walls. One of the difficulties of constructing such walls is keeping them in place and plumb while they are being erected and before an outer membrane is applied.

The prior art practice for keeping straw bale walls in place during construction is to use external bracing, primarily using wood or pipe members. The disadvantages of external bracing (regardless of the materials used) is that the bracing makes the application of the outer membrane difficult, requiring substantial effort and time, which translates directly into added expense. External bracing also consumes materials that are typically discarded. Even if some of the bracing materials are reused or recycled, they add nothing to the structural integrity of the wall after it is fully constructed.

The present invention teaches a system and method for the construction of a straw bale core wall that provides internal bracing during construction that permits walls as high as 24 feet to be constructed with little or no external bracing, and the members and parts that provide the construction phase bracing also become permanent parts of the wall's internal structure. The present invention thus eliminates the difficulties of applying the outer wall membrane when external bracing is in place and uses the same members that provide construction phase bracing as internal structural elements for the finished wall.

BRIEF DESCRIPTION OF THE INVENTION

In the present invention, a wall is constructed using straw bales as a core material. Generally, straw bales are stacked in courses (levels or tiers) in a running bond (a pattern in which the bales of one course are offset one-half bale relative to the bales in the adjacent courses) to the desired height of the building wall and then a membrane is formed to encapsulate the bales. Typically, the membrane is concrete that is pneumatically placed (e.g., shotcrete or gunnite) onto the bales, covering them on both sides to a thickness of 3 inches (for example), creating an exterior membrane and exterior wall surface and an interior membrane and interior wall surface. Metal members that perform a dual function hold the bales in place while they are being stacked and before the membrane is applied. These members keep the stacked bales aligned and upright to a height of up to 24 feet without external bracing and provide the wall with an internal structure that ties the exterior membrane and the interior membrane together to form an extremely strong and durable wall structure independent of the straw bales which function primarily to provide formwork and insulation.

The invention achieves its outstanding results by the strategic placement (both vertically and horizontally) and interconnection of a plurality of ladder structures (trusses) and various tying members. These ladder structures are placed within and immediately adjacent the stacked bales to give the bale walls sufficient out-of-plane strength to remain erect and plumb during construction before the outer membrane is applied and while the outer membrane is applied. When the concrete membrane is applied forming the interior and exterior concrete membranes and wall surfaces, the ladder structures remain in place as part of the inner wall, performing vital structural functions.

The present invention permits the membranes to be applied without the need to work around external bracing, greatly simplifying that process. It follows, of course, that erecting and dismantling external bracing is eliminated, as are the substantial costs and waste associated therewith.

One of the outstanding features of the present invention is that a wall of any height (from 8 feet to 35 feet) can be assembled from small parts which are easily transported to the site and which can be easily stiffened and braced without the need to break the bale bond or change the details. Spars and vertical rebar members are tied or tack welded to form a stiff truss system that stabilizes the wall during construction. For additional stiffness and to help keep the wall true over a length, the same system is used horizontally at any horizontal joint (between a course of bales). Special ladders with narrower dimensions are fabricated for this purpose so that they fit within the vertical system. The vertical spar/truss system of the invention, coupled with a horizontal stiffener at the top course, suffices for walls up to 12 feet in height. For taller walls, a horizontal stiffener is placed either at 12 foot intervals or at a height equal to half the wall height, whichever is less.

Accordingly, it is an object of the present invention to provide internal bracing systems and methods for constructing a straw bale wall.

It is another object of the present invention to provide internal bracing and methods for constructing a straw bale wall to a height of 24 feet without the need for external bracing.

Yet another object of the present invention is to provide systems and methods for constructing a straw bale wall in which permanent internal structural elements act as bracing during construction.

The foregoing and other objectives, features and advantages of the invention will be more readily understood upon consideration of the following detailed description of the invention taken in conjunction with the accompanying drawings.

BRIEF DESCRIPTION OF THE DRAWINGS

FIG. 6 is a front view of a bracing ladder of the present invention;

FIG. 7 is a side view of FIG. 6;

FIG. 8 is a front view of a portion of an alternative embodiment of a bracing ladder of the present invention;

DETAILED DESCRIPTION OF THE PREFERRED EMBODIMENTS

The following description includes specific measurements for purposes of illustration only and, except where otherwise indicated, such specific measurements are not to be taken as a limitation of the invention. For example, the description of the invention is with regard to the use of standard California rice straw bales 16 inches wide by 24 inches high by 48 inches long. These dimensions will dictate certain dimensions for the various metal members of the invention, as well as their spacing. It will be clear to those skilled in the art that should a straw bale of different dimensions be used, the dimensions of the various metal members and their spacing could, and likely would, change accordingly. What does not change is the functional relationship of the various members to one another.

Figure 1:
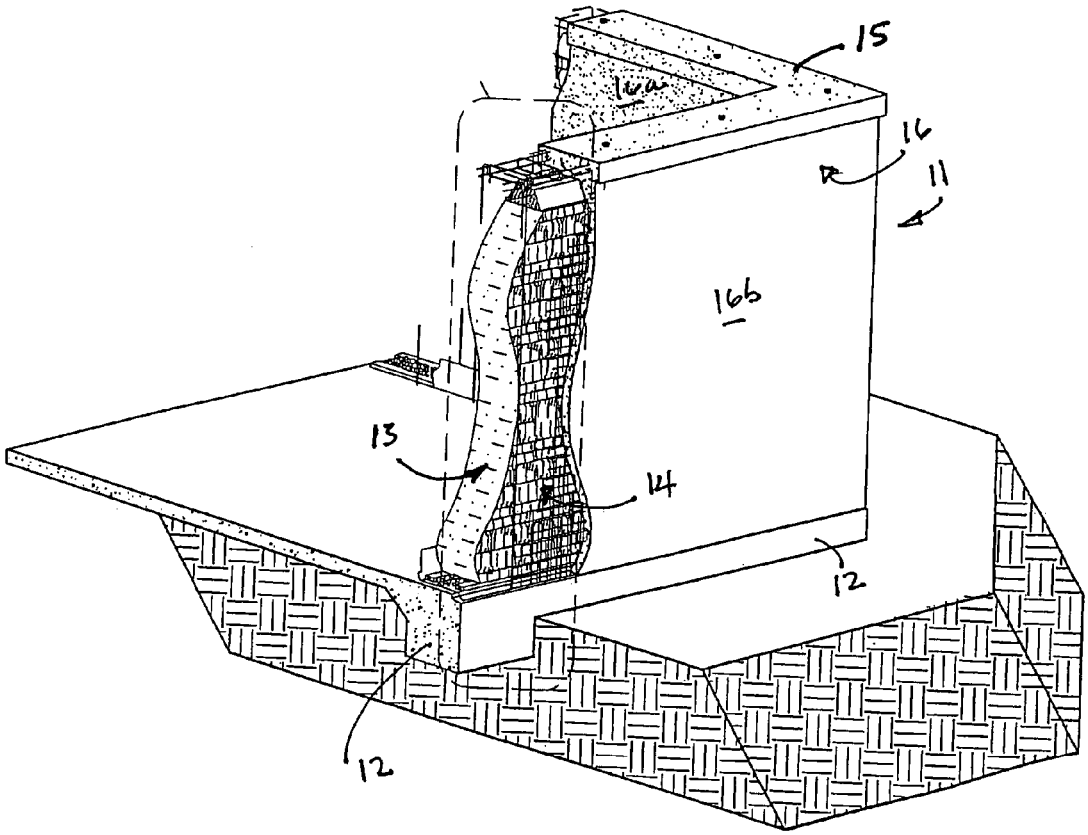
FIG. 1 is a perspective view of a partial straw bale core wall with portions broken away to expose certain parts of the external structure of the wall and foundation.
Figure 2:
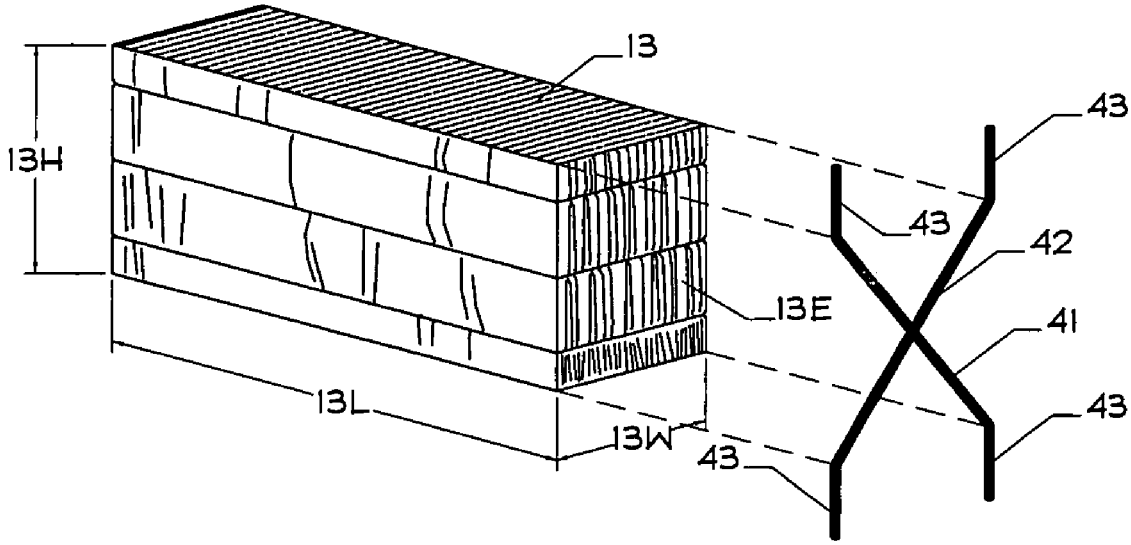
FIG. 2 is a perspective view of a typical bale and connecting spar used in connection with the invention.

Referring to FIGS. 1 and 2, a straw bale wall 11, according to the present invention, is constructed on a foundation wall 12 by stacking straw bales 13 in a running bond within a bracing system 14 of various metal components described in detail below. The bond of bales and bracing system are enclosed by a membrane 16 creating an inner wall surface 16*a* and an outer wall surface 16*b* which are joined at the top of the wall by a bond beam 15.

The metal bracing components 14, which are described in greater detail below, provide all of the bracing necessary during construction so that the application of the membrane 16 (e.g., shotcrete, gunnite or the like) is unencumbered by external bracing members. B1

Each of the straw bales 13 which form the core of the wall 11 are parallelepipeds having a height 13H, a length 13L terminating in opposing ends 13E, and a width or thickness 13W. The invention will be described with reference to a standard California rice straw bale 16 inches wide by 24 inches high by 48 inches long. It will be obvious to those skilled in the art that bales having different dimensions could work equally well with adjustments to certain dimensions of the metal components. The bales 13 are stacked onto foundation wall 12 in an orientation by which the bale length 13L is aligned with the length of foundation wall 12; the height 13H is a measure of the vertical dimension of the stacked bale; and the width 13W constitutes the remaining third dimension, which largely determines the thickness of the wall 11.

Figure 3:
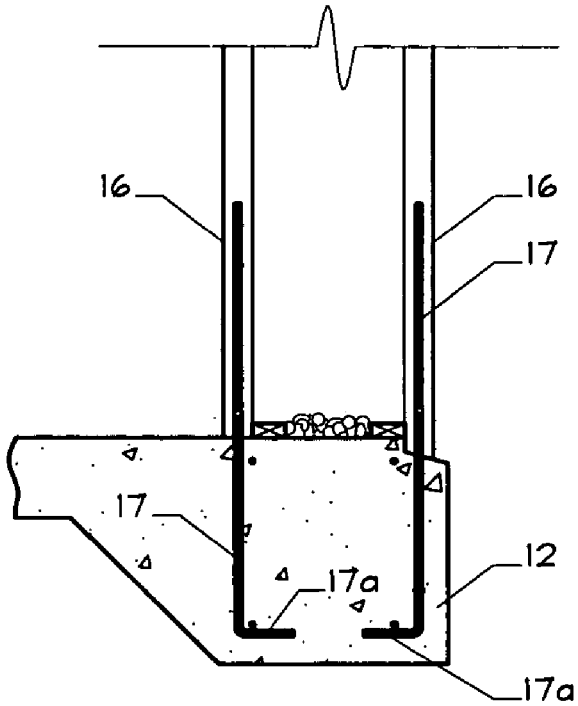
FIG. 3 is an end section view of the foundation wall for the wall of the invention.
Figure 4:
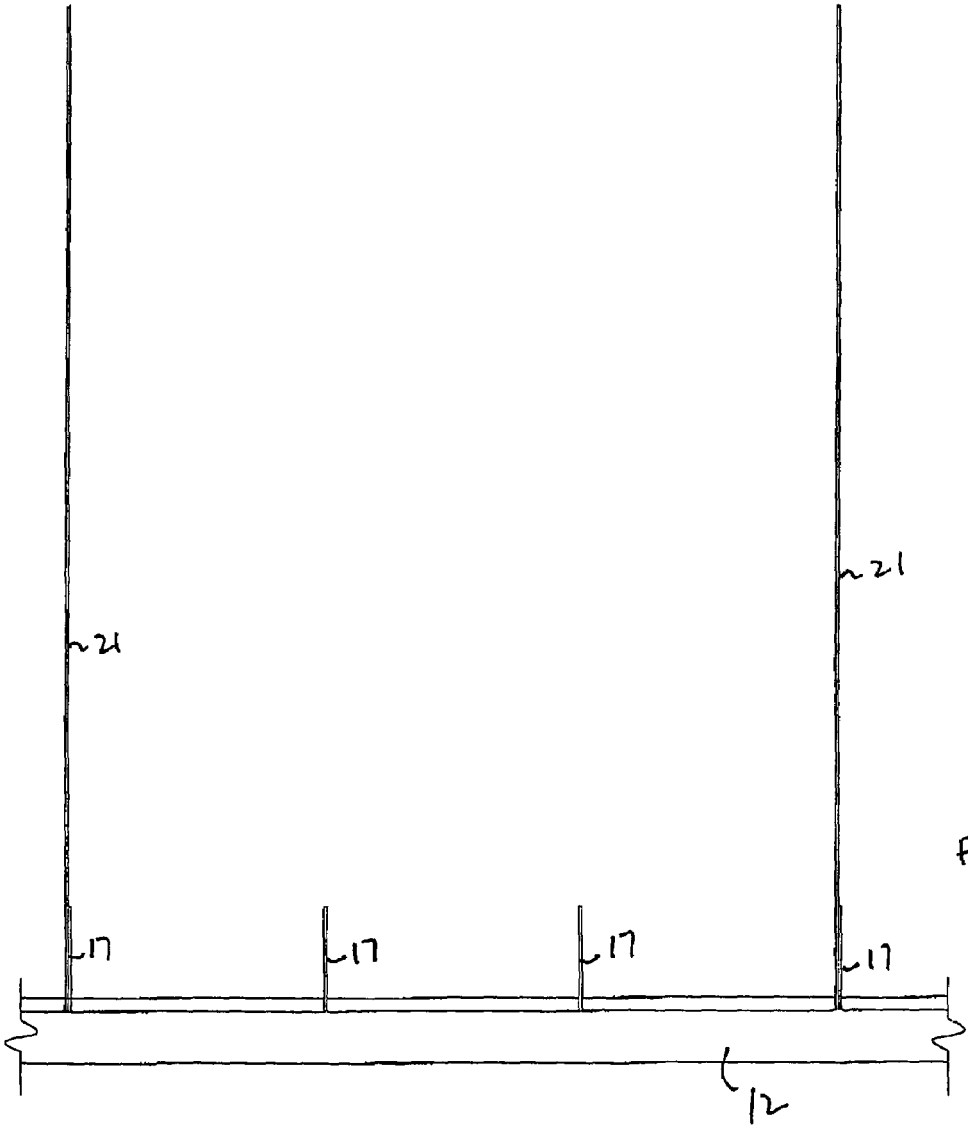
FIG. 4 is a side view of a portion of a wall on which bracing ladders have been erected.
Figure 5:
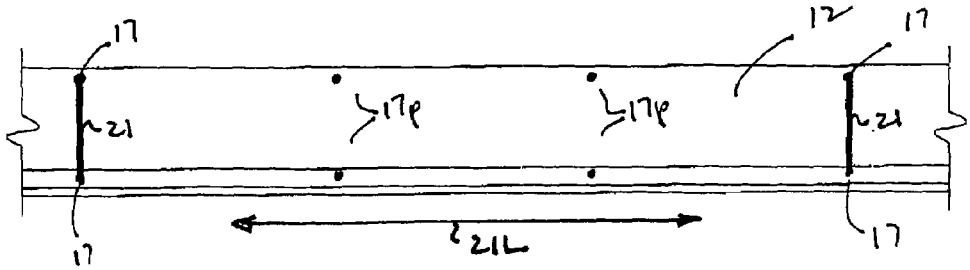
FIG. 5 is a plan view of FIG. 4.

Referring to FIGS. 3, 4 and 5, anchor dowels 17 are cast into the concrete foundation wall 12 and extend vertically above the foundation wall approximately the same height 13H as the bale 13 (see FIG. 2). The anchor dowels 17 terminate in the foundation in a standard hook 17A and are distributed along the length of the foundation wall 12 in opposing pairs 17P, with each dowel 17 near one edge of the foundation wall 12. The dowels 17 of a given pair 17P are spaced apart a greater distance than the bale width 13W of bale 13, and preferably 2 inches to 3 inches greater, so that a bale 13 can readily fit therebetween. Anchor dowel pairs 17P are set along the length of the foundation wall 12 every 2 feet or 4 feet (when using a 4 foot bale). Whether the spacing is half the bale length 13L (2 feet) or a full bale length 13L (4 feet) is dependent on the ultimate size of the wall being built and the conditions of its use. As will become clear from what follows, the choice of spacing (half a bale length or a full bale length) for the anchor dowel pairs 17P is a choice well within the teachings of the invention. B2

Referring to FIGS. 4-8, bracing ladders 21 are secured to the foundation 12 by attachment to an anchor dowel pair 17P. The ladders 21 are distributed along the foundation 12 at intervals equal to three bale lengths 13L, or every 12 feet for a 4 foot bale system. Bracing ladders 21 are secured to the foundation by attachment to an anchor dowel pair 17P by the use of mechanical clamps or the like. The ladders 21 are positioned on the foundation wall 12 so that the plane of the ladders 21 (the plane containing the various parts that make up the ladders 21) is transverse to the length 21L of the foundation 12 and parallel to the ends 13E of bales 13. The height of ladders 21 is approximately equal to the height of the wall 11 (FIG. 1) which can be as high as 35 feet. B3

In one embodiment (FIGS. 6 and 7), bracing ladder 21 has a pair of spaced-apart parallel rails 22 rigidly held in place by horizontal connecting struts 23H and diagonal connecting struts 23D. The struts 23H and 23D not only unify the ladder into a single structural member, but are laid out in a pattern that creates alternating bale windows 24 and bale abutments 26. The spacing between ladder rails 22 is greater than the bale width 13W, and the height 24H of the ladder windows 24 is greater than the height 13H of the bale 13. Thus, each ladder window 24 can surround (accommodate) a bale 13 (a bale 13 can pass through a window 24). Diagonal ladder struts 23D provide an abutment for bales 13, preventing a bale 13 from passing through the ladder at the location of ladder struts 23D.

A foot member 28 at the bottom of each rail 22 provides a fixture for bolting the ladder to the foundation wall 12 as an alternative to, or in addition to, attaching the ladder to an anchor dowel 17, as described above. The various components of the ladder 21 can either be prefabricated into the constructed ladder 21 and shipped to the building site or constructed on site from small parts.

Referring to FIG. 8, another preferred embodiment of bracing ladder 21 of the invention is constructed from #4 galvanized rebar. Ladder rails 32 are two spaced-apart lengths of rebar held together by hourglass-shaped struts 33 which have a core cross-member 34 and legs 36 extending vertically from each end of the core cross-member 34. The connecting struts 33 are also advantageously fabricated from #4 galvanized rebar and affixed to the ladder rails 32 by welding or mechanical clamping means.

The struts 33 are spaced along the length of the ladder 21 to form a pattern of alternating bale windows 37 and bale abutments 38. The hourglass-shaped struts 33 are dimensioned so that the windows 37 are large enough to surround a bale 13 (a bale 13 can pass therethrough), while the abutments 38 prevent bales from passing between the ladder rails 32.

Figure 9:
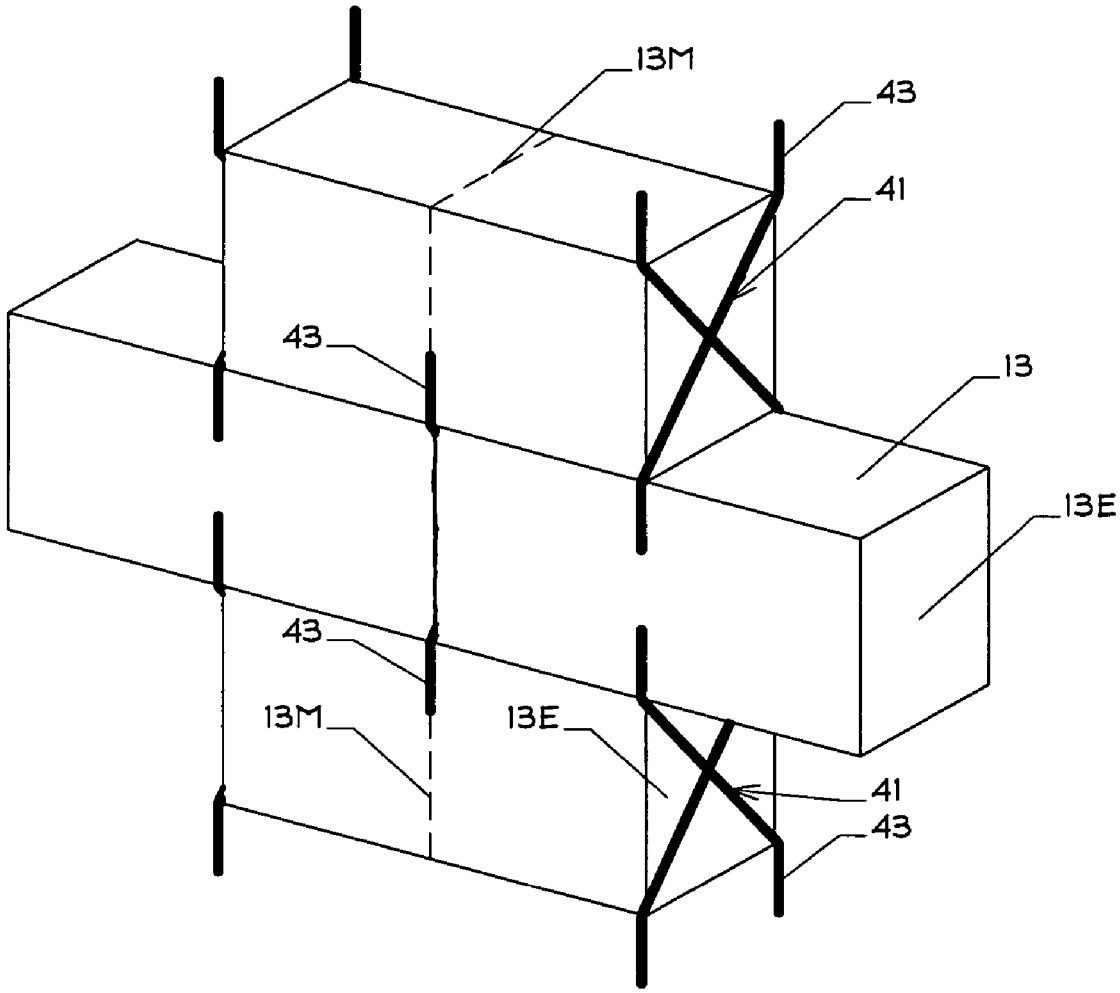
FIG. 9 is a perspective view illustrating four bales in a running bond configuration with stabilizing spars.
Figure 10:
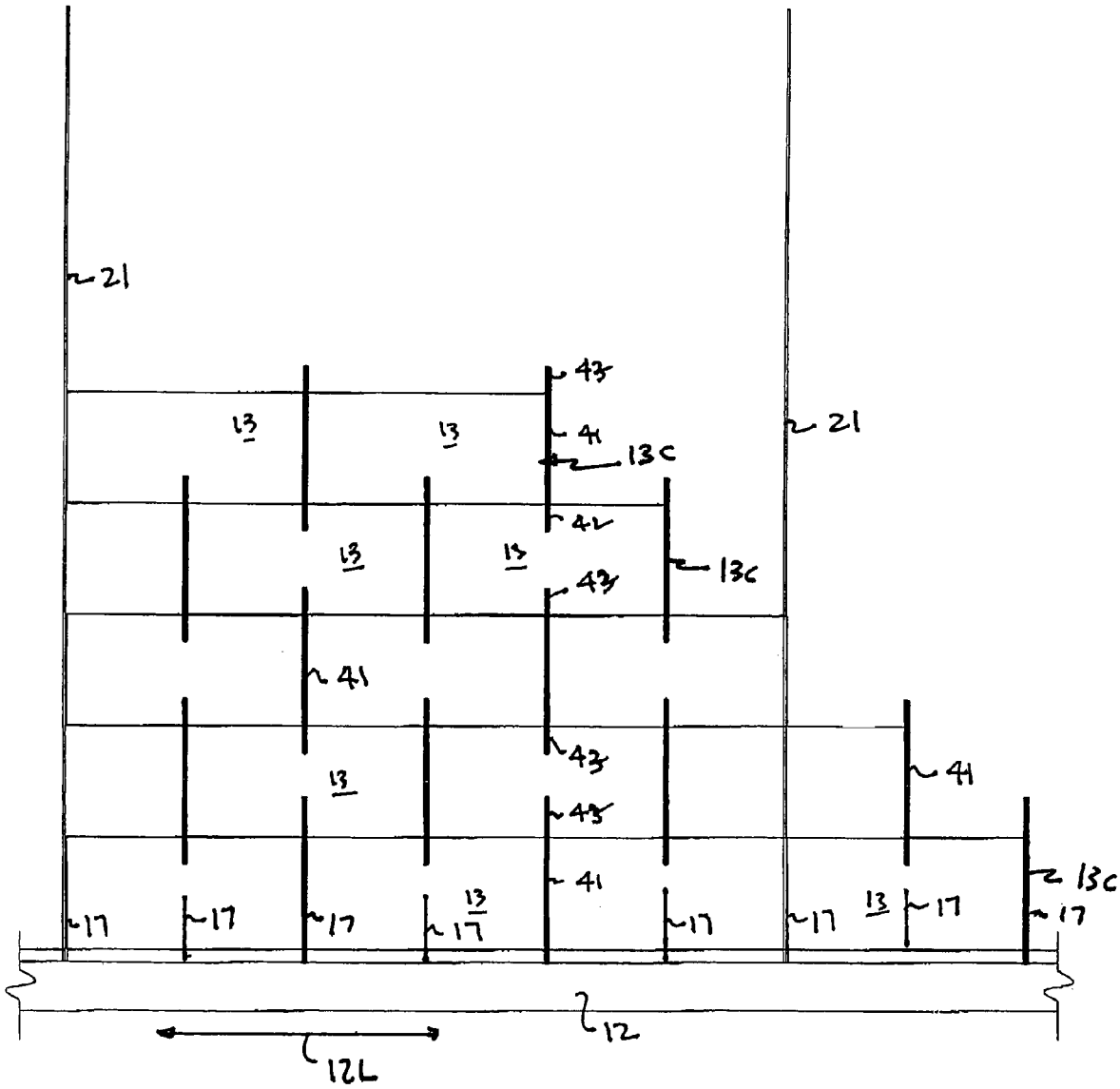
FIG. 10 is a semi-schematic side view of a portion of a wall onto which five courses of bales have been stacked.

Referring to FIGS. 2, 9 and 10, once the ladders 21 have been erected and attached to the foundation 12 at the appropriate intervals, bales 13 are stacked onto the foundation with the length 13L of the bale running in the same direction as the length 12L of the foundation. It will be understood by those skilled in the art that it is not a requirement of the invention that the bales be placed in this orientation.

The bales 13 in the example used here to illustrate the invention are stacked in a running bond in which the bales 13 in a course 13C (layer or tier of bales) is offset one-half bale length 13L (2 feet) relative to the bales in the adjacent course 13C above and below. Thus, the end 13E of every bale 13 is aligned vertically with the midpoint 13M of the bale 13 immediately above and the bale 13 immediately below (see FIG. 9). Throughout the description, the pattern just described of stacking the bales 13 with half-length offsets is referred to as a "running bond."

In the preferred embodiment, a bale abutment 38 (FIG. 8) is located at the bottom of each ladder 21 adjacent the foundation 12. Since the ladders 21 are spaced 12 feet apart (3 bale lengths 13L), the first course of bales can be laid onto the foundation with the end 13E of each third bale falling immediately adjacent a ladder abutment 38. The second course of bales 13 being offset from the course below (as described above) by one-half bale length 13L, it becomes necessary for a bale to pass through the ladder 21, which it is able to do by virtue of the placement of ladder windows 37 one bale height (13H) above each bale abutment 38. Thus, the alternating bale windows 37 and bale abutments 38 of ladder 21 perfectly accommodate the stacking of the bales in a running bond. Furthermore, the intertwining of the bales 13 in the ladders 21 gives the running bond of bales 13 stability.

In addition to the above-described bracing ladders 21, the present invention also utilizes hourglass-shaped bracing spars 41 advantageously constructed from #4 galvanized rebar having a diagonal cross-member 42 and four leg members 43, one extending generally vertically from the end of each diagonal cross-member 42. The legs 43 are spaced apart a distance greater than the width 13W of bale 13, preferably by 2-3 inches, whereby the leg members 43 can straddle a bale 13 (see FIG. 9). As the bales 13 are stacked, a bracing spar 41 is located at the end 13E of some of the bales 13, with the spar legs 43 straddling the approximate midpoint 13M of the bale above and the bale below. Generally, spars 41 are placed at each bale end 13E that is vertically aligned with an anchor dowel 17 which typically will be either every end 13E (where the anchor dowels are at 2 foot spacings) or every other end 13E (where the anchor dowels are at 4 foot spacings). Spars 41 are not placed at the bale ends 13E that abut a ladder 21. The spars 41 are temporarily held in place by the abutment of the adjacent bales, thus, requiring no further securing devices during the stacking process.

Referring to FIG. 10, five courses 13C of bales 13 are stacked in a running bond with bracing spars 41 placed between the ends 13E of all bales 13 (except those abutting a ladder 21). Anchor dowels 17 at 2 foot spacings (half a bale length 13L) along the length of the foundation wall 12 align vertically with the legs 43 of those bracing spars 41 at the same location along the foundation wall 12.

Figure 11:
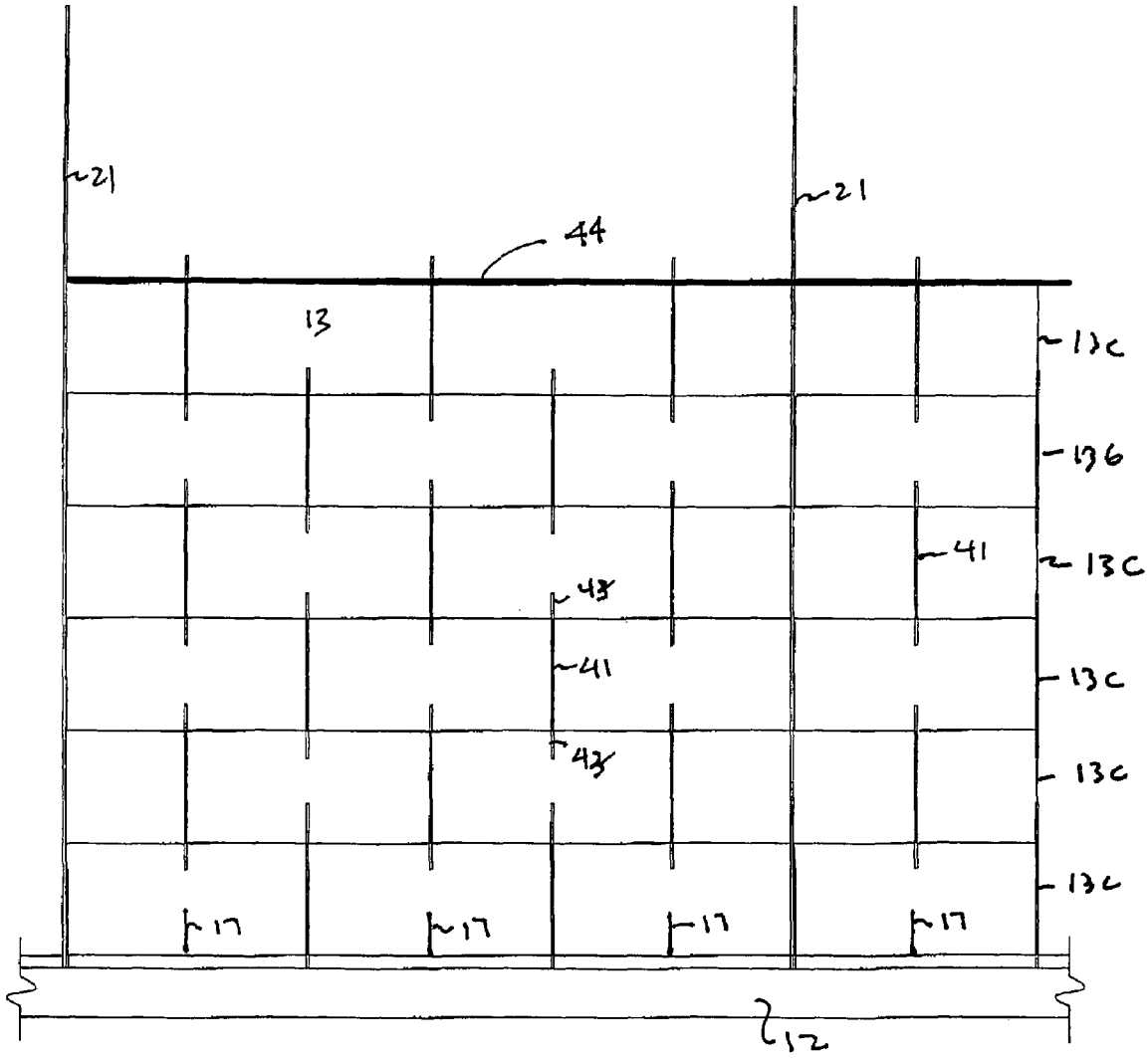
FIG. 11 is the same as FIG. 10, with the addition of a horizontal stiffening ladder.
Figure 12:
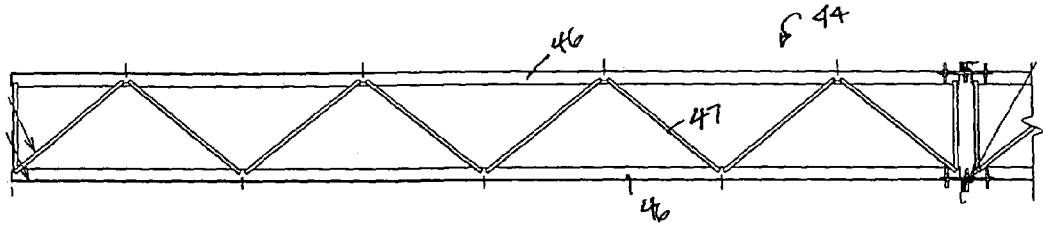
FIG. 12 is a plan view of a stiffening ladder.

Referring to FIGS. 11 and 12, when a stack of bales 13 reaches six courses high (12 feet), it is advantageous to provide horizontal stiffening for additional vertical stabilization. A horizontal stiffening ladder 44 is disposed on top of the sixth course 13C of bales 13 and attached to the bracing ladders 21 to add stiffness to the pre-membrane wall. Ladder 44 has two spaced-apart parallel ladder rails 46 joined by struts 47 in a triangle pattern. The triangular pattern formed by the struts 47 has well known structural advantages, but other structurally sound patterns could be used. The ladder 44 can be prefabricated and shipped to the building site or can be constructed from smaller parts at the site.

The distance between parallel ladder rails 46 of stiffening ladder 44 is preferably just slightly less than the distance between the rails 32 of bracing ladders 21 (see FIG. 8) so that when the stiffening ladders 44 are put in place through bracing ladders 21, the rails of the two ladders will be close to each other to accommodate making a securing connection between them. The maximum distance between the rails 46 of the stiffening ladder 44, however, cannot exceed the distance between the rails 32 of bracing ladder 21.

The stiffening ladder 44 can be conveniently constructed from #4 rebar, with the connecting struts 47 welded to the rails 46. It can alternatively be formed from angle iron members bolted or welded into place.

The stiffening ladder 44 is held in place by connection to the bracing ladders 21 by any one of a variety of mechanical means known for tying metal members together, including simple wire twist ties (not shown).

For walls greater than 12 feet, it is advantageous to have a stiffening ladder 44 located at the top of the sixth course, or at the approximate mid-height of the wall, whichever is less.

Figure 13:
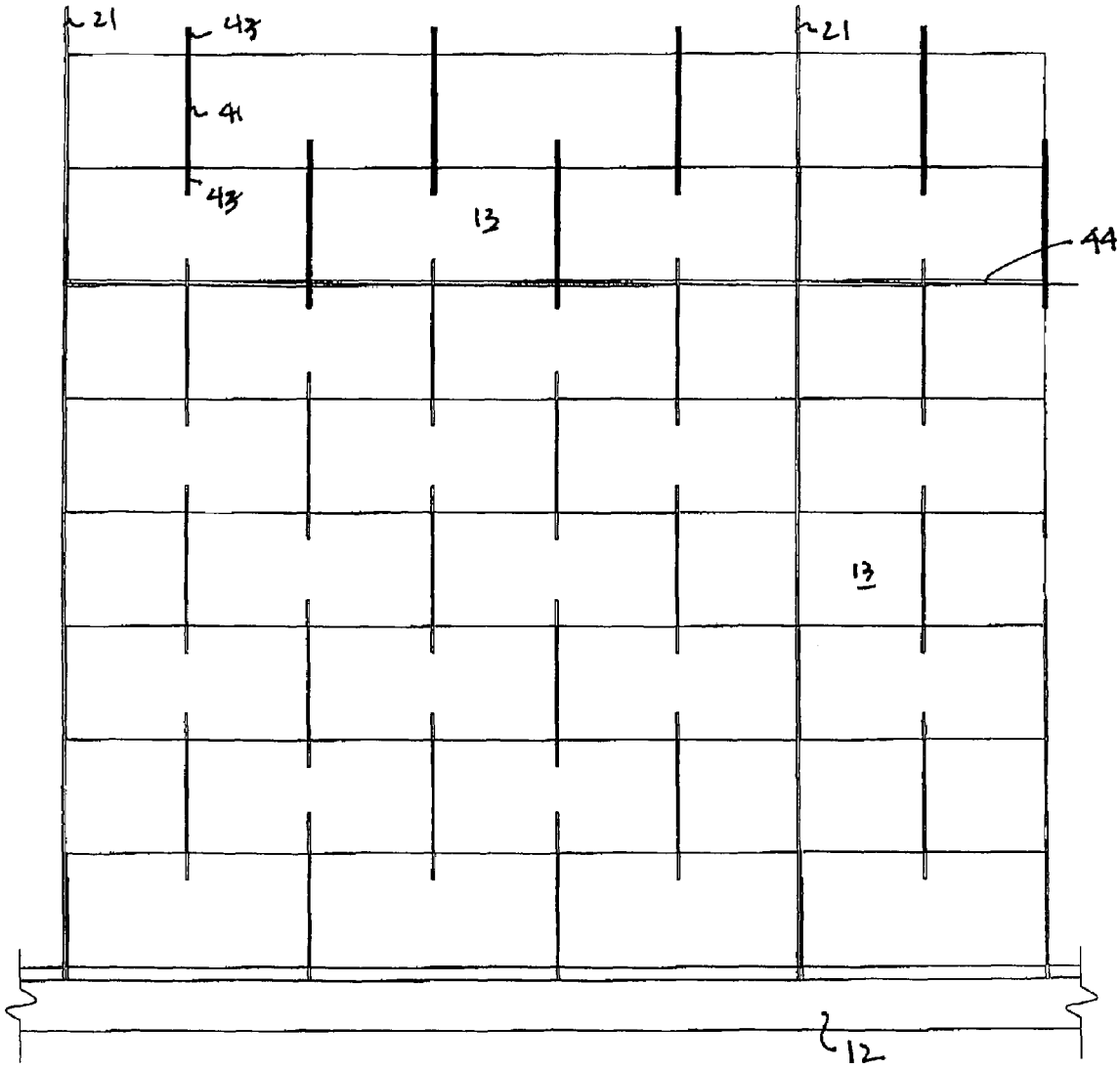
FIG. 13 is the same as FIG. 12, with additional bales shown stacked on top of the stiffening ladder.

Referring to FIG. 13, after the stiffening ladder 44 is in place, bales 13 continue to be stacked in a running bond until the full height of the wall is reached. B4

Figure 14:
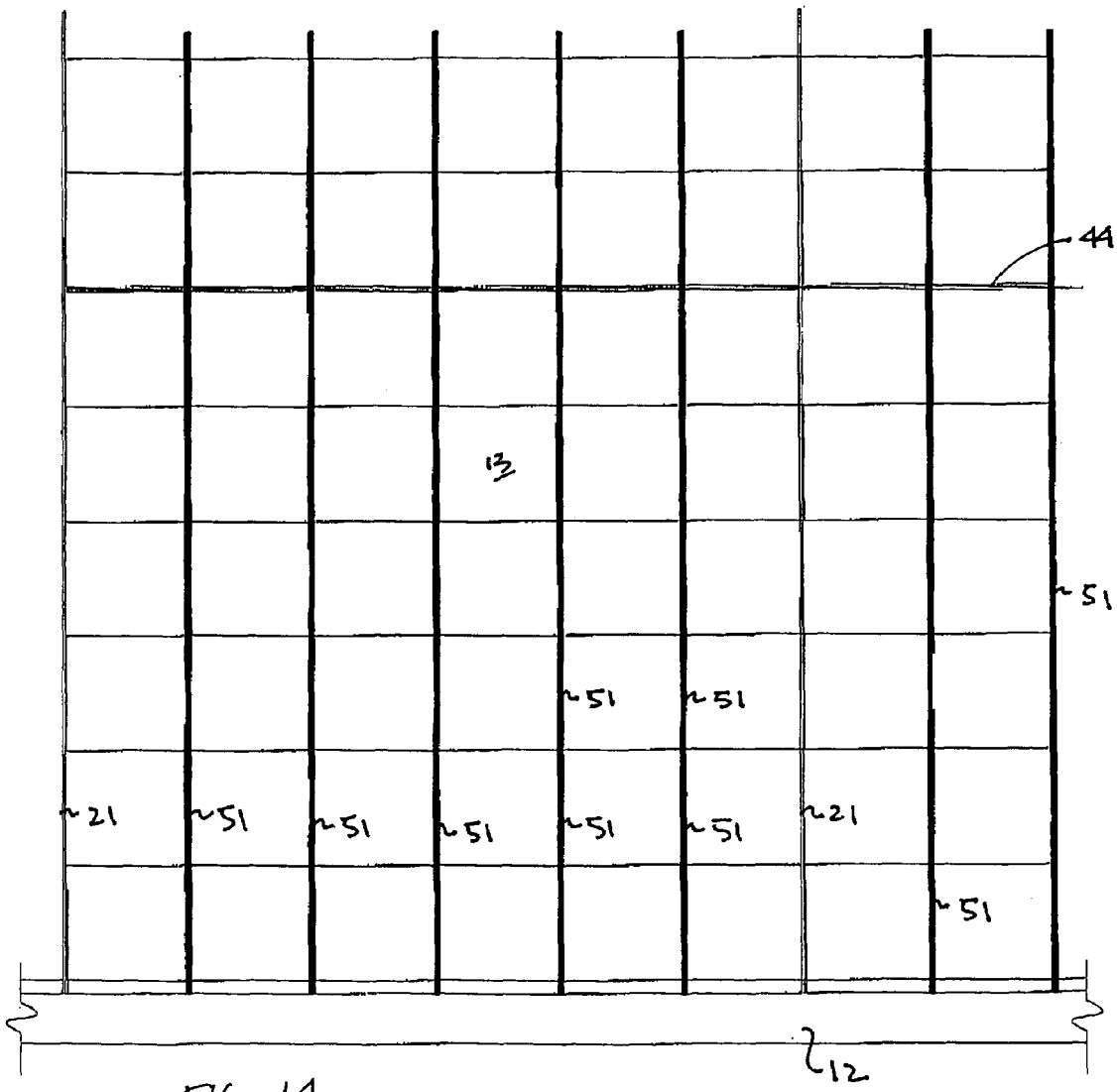
FIG. 14 is the same as FIG. 13, with connecting rods added.
Figure 15:
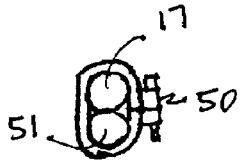
FIG. 15 is a plan view illustrating a clamp connecting two rebar parts together.
Figure 16:
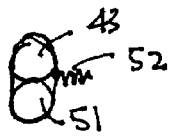
FIG. 16 is a plan view showing two rebar pieces secured together by a wire twist tie.

Referring, in addition, to FIG. 14, when bales 13 have been stacked to the desired height and spars 41 located, the exposed legs 43 of the spars 41 will be aligned with an anchor dowel 17 in the foundation 12. A connecting rod 51, preferably #4 rebar, of a length approximately equal to the height of the wall is secured to each anchor dowel 13 and all of the spar legs 43 aligned with that anchor dowel 17. Because of the highly flammable nature of straw bale material, it is not advisable to attach the connecting rods to the dowel 17 and spar legs 43 by welding. Any one of numerous well known mechanical clamping mechanisms for securing two lengths of rebar together (such as compression clamp 50, as shown in FIG. 15) is suitable for attaching the connecting rods 51 to the anchor dowels 17. While similar clamping mechanisms can be used to attach the spar legs 43 to a connecting rod 51, connecting them together with simple wire ties 52 (as indicated in FIG. 16) is satisfactory. Once the connecting rods 51 are secured to dowels 17, spar legs 43 and ladder(s) 44 (if any), a structurally rigid truss system has been constructed that is fully capable of supporting the wall during the application of the membrane 16 (see FIG. 1) without external bracing.

Figure 17:
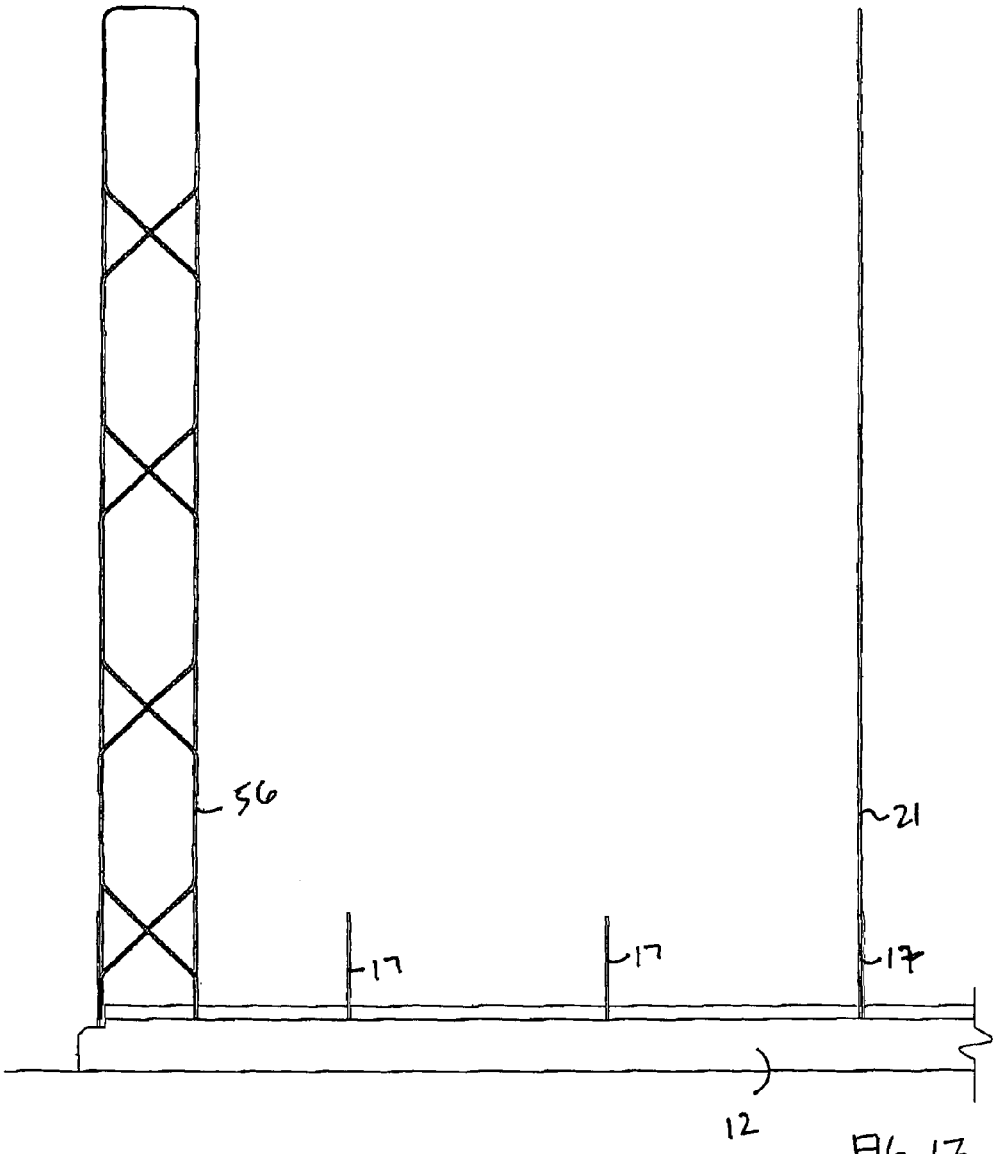
FIG. 17 is the same as FIG. 4, but including a corner of the foundation wall and a corner bracing ladder.
Figure 18:
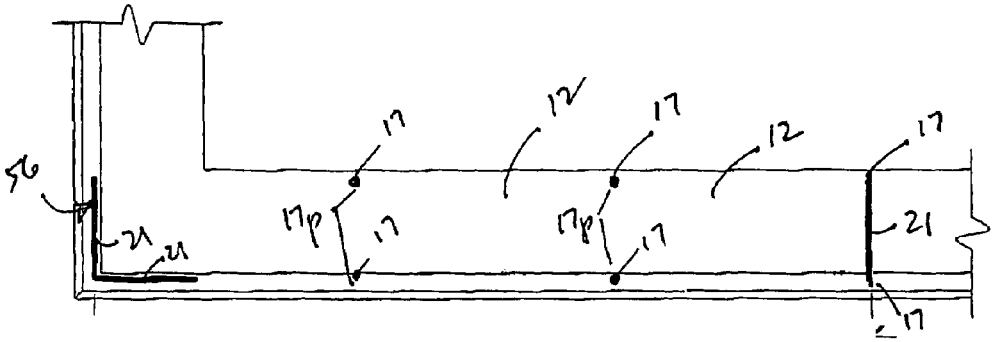
FIG. 18 is a plan view of FIG. 17.

Referring to FIGS. 17 and 18, a corner ladder 56 can be constructed by securing (as by welding or other connecting means) two mid-wall ladders 21 together at right angles to each other. Once anchored to the foundation 12 by attachment to anchor dowels 17 and plumbed, corner ladders 56 provide a reference and structure by which the mid-wall ladders 21 can be plumbed prior to stacking bales 13.

Figure 19:
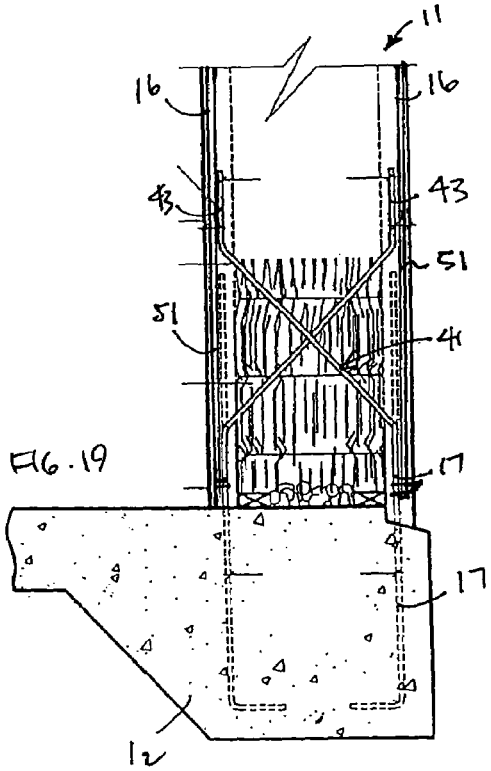
FIG. 19 is an end view of the foundation wall onto which a single course of straw bales has been stacked, together with a bracing spar and connecting rods.
Figure 20:
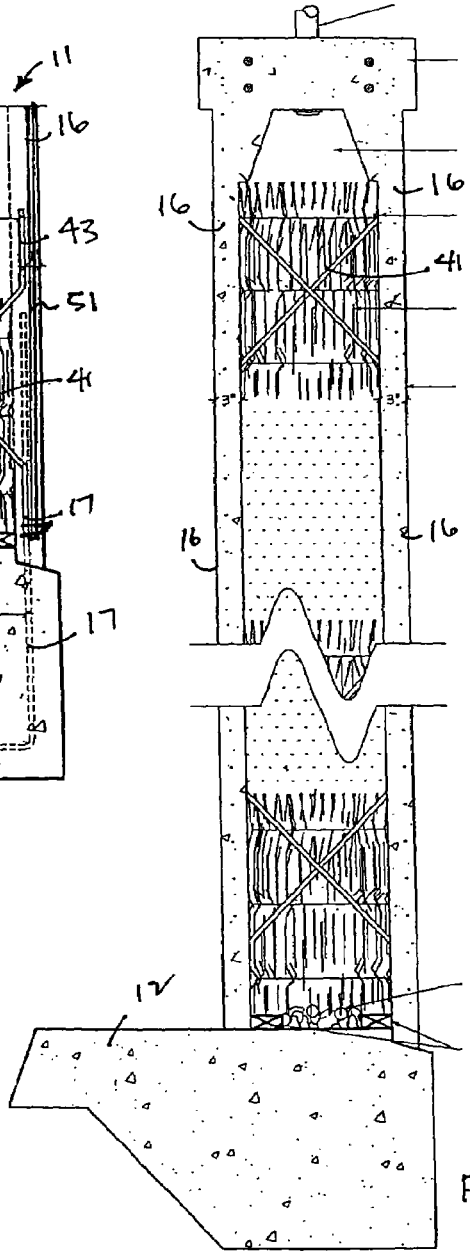
FIG. 20 is an end view of the wall of the present invention showing the foundation and the bond beam.

Referring to FIGS. 19 and 20, the membrane 16 is applied to a thickness of approximately 3 inches to fully encase the exposed anchor dowels 17, spar legs 43 and the connecting rods 51. All of the metal components within the interior membrane 16 are physically joined to the metal components within the exterior membrane 16 by spars 41 and ladders 21, creating a wall of exceptional structural integrity.

The outstanding structural characteristics of the wall 11—both before the membrane is applied and after—are largely attributable to the several metal components described in detail above, whereas the bales 13 serve primarily as construction forms, fireproofing and insulation.

While the invention has been described and illustrated utilizing a standard California rice straw bale 16 inches wide by 24 inches high by 48 inches long, and various dimensions have been suggested based on that bale size, the invention is capable of fully functioning with bales of different dimensions, in which case, the spacing of the various components of the invention would have to be modified accordingly. While the invention has been described with regard to anchor dowels spaced every 2 feet (half a bale length) along the length of the foundation, under certain conditions and for walls of only moderate height, spacings of 4 feet (one bale length) is adequate. When full-length bale spacing is used for the anchor dowels, it is only necessary to place the hourglass-shaped spars 41 at the head of those bales that align with an anchor dowel.

Figure 21:
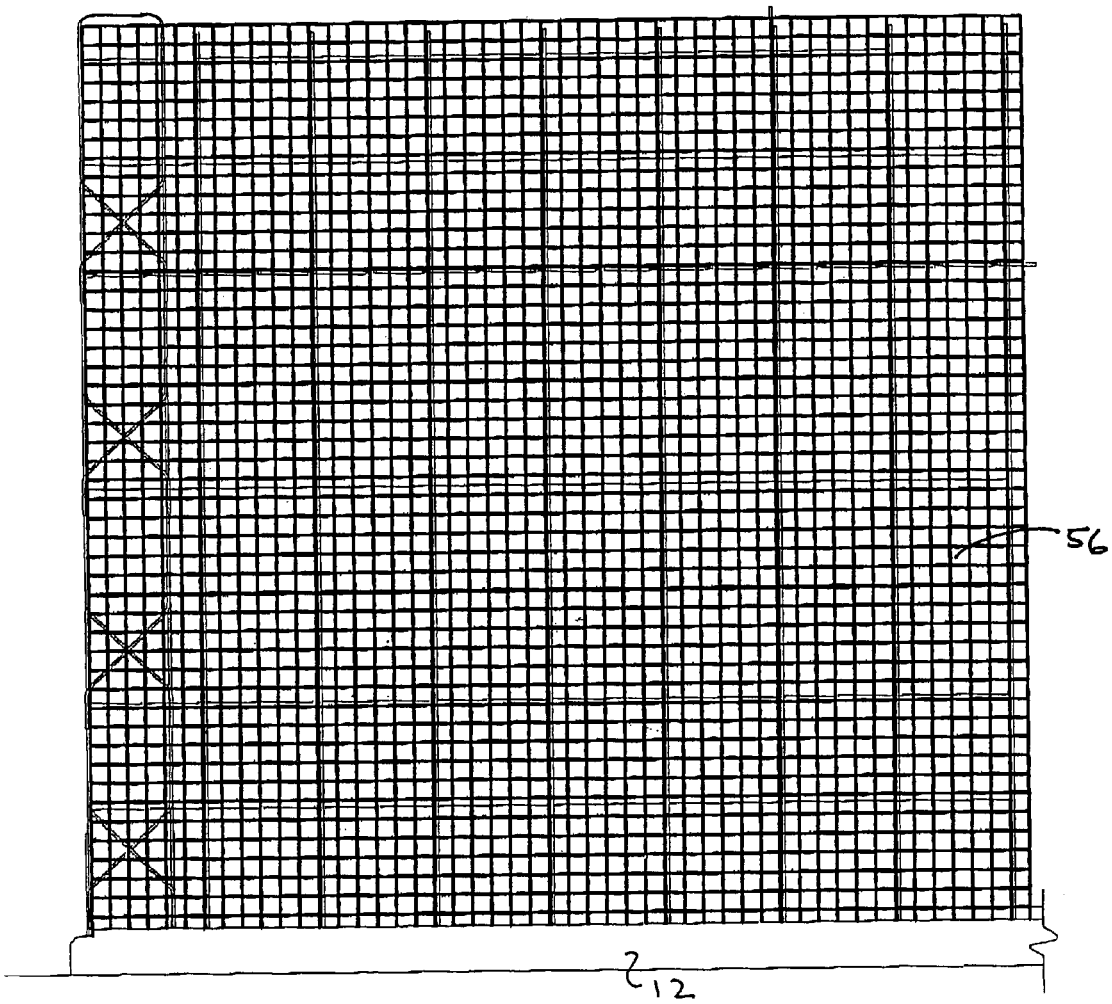
FIG. 21 is the same as FIG. 14, with the addition of welded wire fabric covering the interior structure of the wall.

Referring to FIG. 21, prior to applying the membrane 16 (FIG. 1), it is advantageous to cover the metal bracing components with welded wire fabric 56.

The foregoing teaches a series of steps for constructing a straw bale core wall onto a foundation wall having vertically extending #4 rebar anchor dowels spaced apart along the foundation wall at 24 inch or 48 inch spacings (assuming use of a standard 4 foot bale length) without external bracing, which steps comprise:

(1) Attaching preassembled vertical corner bracing ladders (of rebar or other metal components) to the foundation wall at its corners.

(2) Attaching preassembled vertical mid-wall bracing ladders (of rebar or other metal components) between foundation wall corners.

(3) Plumbing the corner ladders and intermediate ladders.

(4) Stacking straw bales onto the foundation wall in a running bond and installing a cross spar with spar legs at the head of every bale or every other bale, as required.

(5) Installing a horizontal preassembled stabilization ladder onto the top of the sixth course of bales (approximately 12 feet) and securing it to the vertical ladders.

(6) Stacking straw bales until the final wall height is reached.

(7) Adding vertical connecting rods at the location of the spars running from the foundation to the top of the wall.

(8) Tying each vertical connecting rod to an anchor dowel protruding from the foundation, as well as the legs of each spar leg in line vertically with the anchor dowel.

(9) Covering the bales and metal parts with welded wire fabric and tying it to the vertical connecting rods.

(10) Applying a membrane (typically pneumatically placed shotcrete or gunnite) over the bales 13 and internal bracing system 14 that covers the bales and metal components.

Of course, various changes, modifications and alterations in the teachings of the present invention may be contemplated by those skilled in the art without departing from the intended spirit and scope thereof. As such, it is intended that the present invention only be limited by the terms of the appended claims.

What is claimed is:

1. A vertical wall structure comprising:

a foundation wall that has a length and a width;

a plurality of individual, generally uniform sized straw bales stacked a plurality of courses high on said foundation wall wherein said bales have the general shape of a regular parallelepiped having a width, a height and a length terminating in opposing ends and said bales are stacked on said foundation wall with their lengths aligned with the length of said foundation wall:

a plurality of vertically oriented bracing ladders attached to the foundation wall at spaced apart locations along the length of the foundation wall wherein each said ladder is a truss formed by a pair of spaced apart vertically oriented rails and struts affixed to and connecting said rails with said struts and rails lying in a common plane, said ladders being disposed at locations on said foundation wall whereby the common plane of said ladders is transverse to the length of said foundation wall and generally parallel to the ends of said bales; and a plurality of X-shaped spars disposed at ends of said bales and having opposing pairs of legs that straddle the bale in an adjacent course above and below the end of said bale at which said spar is located;

anchor dowels affixed in the foundation wall and extending vertically upwardly from said foundation wall; and a connecting rod attached to and extending vertically upwardly from an anchor dowel and attached to a plurality of said X-shaped spars.

2. The wall structure of claim 1 wherein said bales are stacked in a running bond.

3. A method of constructing a wall having a core of straw bales comprising:

onto a foundation wall that has a length and a width affix a plurality of vertically oriented bracing ladders at spaced apart locations along the length of the foundation wall wherein each bracing ladder is a truss formed by a pair of spaced apart vertically oriented rails and struts which are attached to and connect said rails with the struts and rails lying in a common plane, with bracing ladders being oriented such that the common plane of the ladders is transverse to the length of the foundation wall and generally parallel to the width of the foundation wall;

stacking onto the foundation wall and among the bracing ladders a first course of a plurality of straw bales having the general shape of a regular parallelepiped with a width, height and length terminating in opposing ends wherein the bales are placed end-to-end with their lengths parallel to the length of the foundation wall;

stacking onto said first course of bales and among the bracing ladders a second course of bales;

continuing to add courses of straw bales onto the next previous course and among the bracing ladders as with the previous course until the desired height of the wall is reached, while stacking bales to form the next course placing an X-shaped spar having opposing pairs of legs at the end of one or more bales; and connecting all vertically aligned spar legs together and to the foundation wall.

4. An internal structure for a building wall having a foundation wall that has a length and a width comprising:

a plurality of vertically oriented bracing ladders attached to the foundation wall at spaced apart locations along the length of the foundation wall wherein each said ladder is a truss formed by a pair of spaced apart vertically oriented rails and struts affixed to and connecting said rails wherein said struts and rails lying in a common plane, said ladders being oriented relative to said foundation wall whereby the common plane of said ladders is transverse to the length of said foundation wall and generally parallel to the width of said foundation wall;

a plurality of pairs of connecting rods attached to and extending vertically upwardly from said foundation wall wherein each said pair of connecting rods lies in a plane generally parallel to the common plane of said bracing ladders; and a plurality of X-shaped spars disposed between and attached to a said pair of connecting rods.

5. The internal structure of claim 4 further comprising:

a plurality of anchor dowels secured within and extending above said foundation wall and attached to said connecting rods whereby said connecting rods and said X-shaped spars are attached to the foundation wall.

6. The internal structure of claim 4 wherein said connecting rods are anchored in the foundation wall.

7. A method of constructing an internal structure for a wall onto a foundation wall having a length and a width comprising:

affixing a plurality of vertically oriented bracing ladders at spaced apart locations along the length of the foundation wall wherein each bracing ladder is a truss formed by a pair of spaced apart vertically oriented rails and struts that are attached to and connect said rails wherein the struts and rails lie in a common plane, wherein the bracing ladders are oriented such that the common plane of the ladders is transverse to the length of the foundation wall and generally parallel to the width of the foundation wall;

attaching pairs of connecting rods to and extending vertically upwardly from said foundation wall wherein each said pair of connecting rods lies in a plane generally parallel to the common plane of said bracing ladders;

attaching X-shaped spares to and between pairs of connecting rods whereby the spars lie in a plane generally parallel to the plane of said connecting rods pairs and the common plane of the bracing ladders.

8. The method of claim 7 further comprising:

anchoring anchor dowels in the foundation wall such that they extend above the foundation wall; and attaching connecting rods to the anchor dowels.

9. The method of claim 7 wherein the connecting rods are anchored in the foundation wall.

10. An internal wall structure on a foundation wall that has a length and a width comprising:

a plurality of individual, generally uniform sized straw bales stacked a plurality of courses high on said foundation wall wherein said bales have the general shape of a regular parallelepiped having a width, a height and a length terminating in opposing ends and said bales are stacked on the foundation wall with their lengths aligned with the length of the foundation wall:

a plurality of vertically oriented bracing ladders attached to the foundation wall at spaced apart locations along the length of the foundation wall wherein each said ladder is a truss formed by a pair of spaced apart vertically oriented rails with struts affixed to and connecting said rails wherein said struts and rails lie in a common plane, said ladders being disposed at locations on said foundation wall whereby the common plane of said ladders is transverse to the length of said foundation wall and generally parallel to the ends of said bales without penetrating the interior of any said bales.

* * * * *